US010961849B2

(12) United States Patent
Lindsey

(10) Patent No.: US 10,961,849 B2
(45) Date of Patent: Mar. 30, 2021

(54) ROTARY PISTON AND CYLINDER DEVICE

(71) Applicant: LONTRA LIMITED, Southam (GB)

(72) Inventor: Stephen Francis Lindsey, Southam (GB)

(73) Assignee: LONTRA LIMITED, Southam (GB)

( * ) Notice: Subject to any disclaimer, the term of this patent is extended or adjusted under 35 U.S.C. 154(b) by 128 days.

(21) Appl. No.: 15/328,842

(22) PCT Filed: Jul. 24, 2015

(86) PCT No.: PCT/GB2015/052149
§ 371 (c)(1),
(2) Date: Jan. 24, 2017

(87) PCT Pub. No.: WO2016/012807
PCT Pub. Date: Jan. 28, 2016

(65) Prior Publication Data

US 2017/0211387 A1 Jul. 27, 2017

(30) Foreign Application Priority Data

Jul. 24, 2014 (GB) ..... 1413170

(51) Int. Cl.
*F01C 3/02* (2006.01)
*F01C 11/00* (2006.01)
(Continued)

(52) U.S. Cl.
CPC ..... *F01C 3/025* (2013.01); *F01C 11/004* (2013.01); *F02B 55/08* (2013.01); *F02B 53/00* (2013.01)

(58) Field of Classification Search
CPC ..... F01C 3/02; F01C 11/004; F02B 55/08; F04C 18/52
(Continued)

(56) References Cited

U.S. PATENT DOCUMENTS 2,411,707 A * 11/1946 Biermann ..... F04C 18/52 418/195
4,391,574 A 7/1983 Medel, Jr. et al.
7,080,976 B2 * 7/2006 Didin ..... F01C 3/02 418/195

FOREIGN PATENT DOCUMENTS

DE 26 41 451 3/1978
DE 195 09 913 9/1996
(Continued)

OTHER PUBLICATIONS

United Kingdom Search Report dated Feb. 20, 2015 in corresponding United Kingdom Application No. GB1413170.0.
(Continued)

*Primary Examiner* — Deming Wan
(74) *Attorney, Agent, or Firm* — Whiteford, Taylor & Preston, LLP; Peter J. Davis

(57) ABSTRACT

A rotary piston and cylinder device (1) comprising a rotor (2), a stator and a shutter disc (3), the rotor comprising a piston (5) which extends from the rotor into the cylinder space, the rotor and the stator together defining the cylinder space, the shutter disc passing through the cylinder space and forming a partition therein, and the disc comprising a slot (3*a*) which allows passage of the piston therethrough, the slot provided between two surface portions which receive the piston therethrough,at least one of the surfaces defines a close-running region with the piston to provide a fluid seal, and for at least part of the period during which the piston passes through the slot, the close-running region is offset from a mid-plane which extends through the disc and is co-planar with the disc.

20 Claims, 12 Drawing Sheets

(51) Int. Cl.
*F02B 55/08* (2006.01)
*F04C 18/52* (2006.01)
*F02B 53/00* (2006.01)

(58) Field of Classification Search
USPC ..... 418/195, 207, 68; 123/200–249
See application file for complete search history.

(56) References Cited

FOREIGN PATENT DOCUMENTS

| | | |
|---|---|---|
| EP | 0 933 500 | 8/1999 |
| GB | 1068067 | 7/1964 |
| WO | 91/14859 | 10/1991 |
| WO | 2007/093818 | 8/2007 |
| WO | 2010/023487 | 3/2010 |

OTHER PUBLICATIONS

International Search Report dated Nov. 6, 2015 in corresponding International Application No. PCT/GB2015/052149.

* cited by examiner

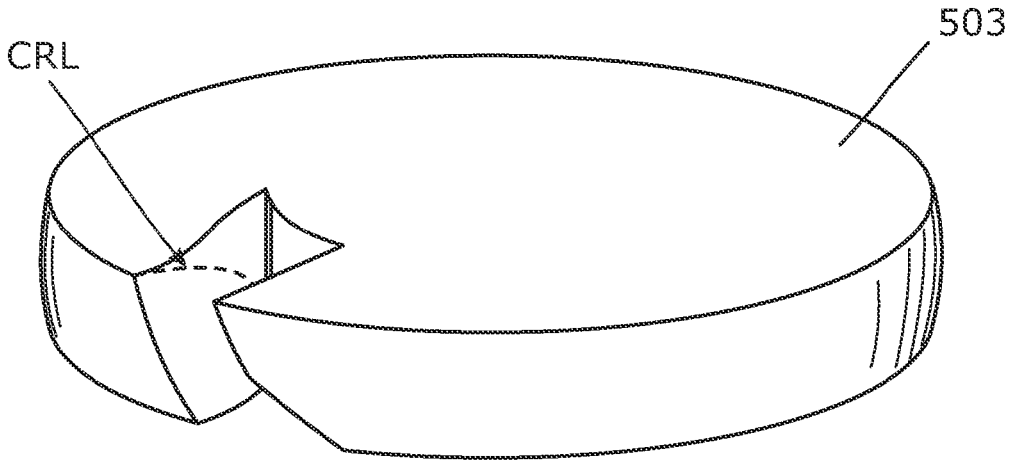
FIGURE 11
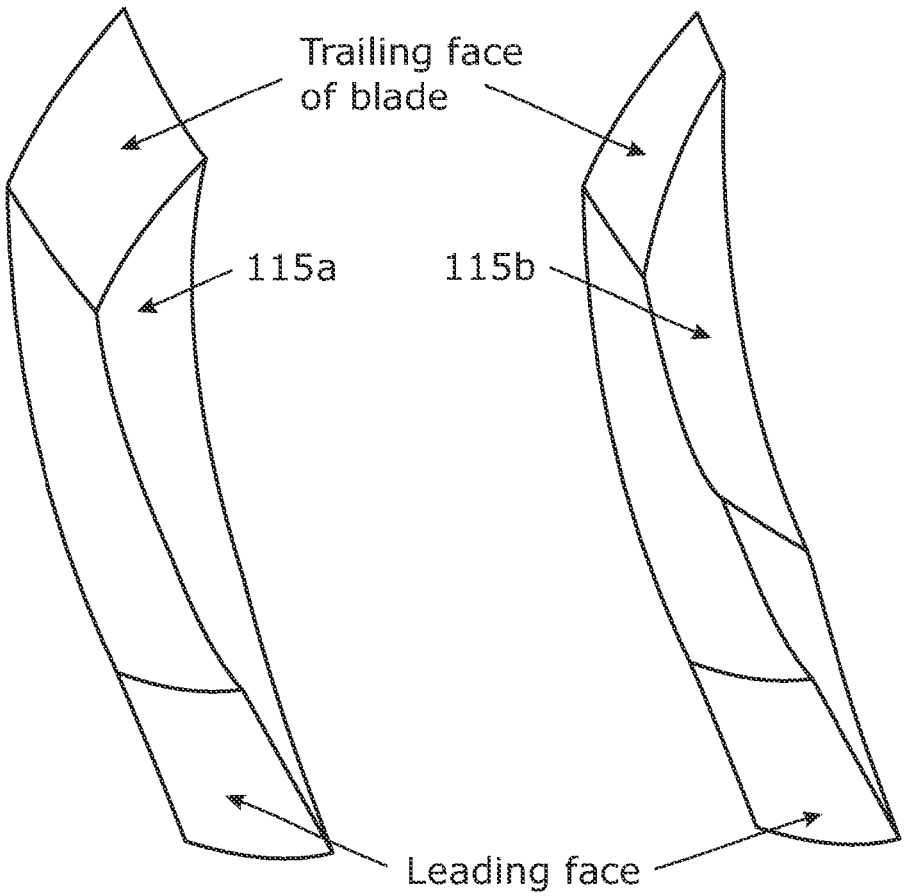
FIGURE 12
FIGURE 13

ROTARY PISTON AND CYLINDER DEVICE

TECHNICAL FIELD

The present invention relates to rotary piston and cylinder devices.

BACKGROUND

Rotary piston and cylinder devices can take the form of an internal combustion engine, or a compressor such as a supercharger or fluid pump, or as an expander such as a steam engine or turbine replacement, and also as a positive displacement device.

A rotary piston and cylinder device comprises a rotor and a stator, the stator at least partially defining an annular cylinder space, the rotor may be in the form of a ring, and the rotor comprising at least one piston which extends from the rotor into the annular cylinder space, in use the at least one piston is moved circumferentially through the annular cylinder space on rotation of the rotor relative to the stator, the rotor being sealed relative to the stator, and the device further comprising cylinder space shutter means which is capable of being moved relative to the stator to a closed position in which the shutter means partitions the annular cylinder space, and to an open position in which the shutter means permits passage of the at least one piston, the cylinder space shutter means comprising a shutter disc.

The term 'piston' is used herein in its widest sense to include, where the context admits, a partition capable of moving relative to a cylinder wall, and such partition need not generally be of substantial thickness in the direction of relative movement but can be in the form of a blade. The partition may be of substantial thickness or may be hollow. The shutter disc may present a partition which extends substantially radially of the cylinder space.

We have devised improved sealing arrangements for such devices.

The geometry of the interior surface of the rotor is governed by at least part of the outer face of the rotating shutter disc that allows the piston to pass through an aperture at the end of a stroke. The piston has to pass through the disc preferably once in each cycle, while forming at least a partial seal to both the cylinder wall and aperture in the disc, as the chamber still contains the working fluid and in most configurations is still connected to the outlet port (in a compressor), or more generally to the volume at working pressure. It should be noted that where the term seal is used, we include the meaning of an arrangement which reduces the clearance, minimising leakage, and not necessarily completely preventing fluid transfer across the seal.

The solution apparent to one skilled in the art is to prioritise the sealing on the working face of the piston, by defining a close running geometry at a mid-plane of the disc. The close-running geometry can be formed of a set of points, or preferably a continuous line which may be curved or straight. The working face of the piston can be defined from this close-running geometry, taking into account the relative motions of the disc and rotor. It can be seen that this approach will result in a piston and disc that will maintain a substantially constant and minimal clearance at the close-running line throughout the passage of the piston through the disc. To each side of the close-running line, with respect to the thickness off the disc, the working face of the blade will be a variable and substantially greater distance away from the surface of the aperture in the disc.

One method to create the blade and aperture geometry as described above is to first also define a close-running geometry for the opposite face of the piston, which can have a larger clearance as it is less critical. The close-running geometry is then swept along the rotor within its coordinate system to form the piston surface. The aperture is then formed by sweep-cutting the disc using the same sealing cross-section within its coordinate system. The lead-in and lead-out surface regions each side of the sealing plane are then formed by sweep-cutting the disc using the leading and trailing edge cross-sections of the piston, within the disc coordinate system. An example of such an arrangement is shown in FIGS. 1A to 1D, which show an end on view of a piston blade 103 passing through a slot 102 in a shutter disc 101, viewed through a wall of the rotor, which is omitted for clarity. The close-running line, CRL, lies on a (mid-) plane 105 which is central of the shutter disc relative to the depth/height of the circumferential surface 101*a* which is (at some point in time) in close co-operation with the rotor. In this arrangement, the close running line remains in this position as the (blade) passes through the slot. As can be seen from the Figures, the leading and trailing edges pass through different regions of the volume of the slot 102. In particular, 'face a' initially passes substantially closer to the lower region of the slot, and then substantially closer to the upper region of the slot. It will be understood that in other embodiments of the device, this can apply in the opposite sense. In this particular embodiment, this leads to a gap between the piston and shutter disc before the leading edge of the piston reaches the CRL. This gap can allow leakage of fluid out of the cylinder, depending on the configuration of the device.

It will be understood that various methods of forming suitable disc slot geometries are possible, and that embodiments of the present invention may be realised by any suitable method that results in the required geometry. Moreover, a piston shape could be realised based on a given slot configuration, as opposed to vice versa, and thereby achieving a suitable slot/shutter disc interface.

An aim of the present invention is to provide a preferred arrangement of the sealing interface between blade and shutter disc aperture. "Sealing interface" refers broadly to the faces of the piston and disc aperture, and "close-running region/line" refers to the set of points of the disc that represent a substantially minimal sealing gap at the sealing interface, between a working face of the blade and disc aperture. The close-running line may be formed of multiple discrete sections, but is preferably a single continuous line.

SUMMARY

According to the invention there is provided a rotary piston and cylinder device comprising a rotor, a stator and a shutter disc, the rotor comprising a piston which extends from the rotor into the cylinder space, the rotor and the stator together defining the cylinder space, the shutter disc passing through the cylinder space and forming a partition therein, and the disc comprising a slot which allows passage of the piston therethrough, the slot provided between two surface portions which receive the piston therethrough, at least one of the surfaces defines a close-running region with the piston to provide a fluid seal, and for at least part of the period during which the piston passes through the slot, the close-running region is offset from a mid-plane which extends through the disc and is co-planar with the disc.

The mid-plane may be coincident with a radial plane of the rotor The mid-plane of the disc may be located substantially midway of the depth/height of the circumferential surface of the disc which is in close co-operation with the rotor, for at least part of the circumferential extent of said surface. Preferably the plane is so positioned for a major extent of the circumferential surface.

The close-running region may be arranged to translate in relation to the thickness of the disc during progression of the blade through the slot.

The surfaces between which the slot is provided may be (directly) opposed to one another.

The surfaces may have non-similar profile shapes, and one of the surfaces (the surface which is not used to form the close-running line) may be formed on the basis of ease of manufacture, for example by way of a square cut.

Only one of the surfaces of the slot may be configured to be the face interacting with the working face of the piston, forming the close-running line with the piston.

The at least one aperture of the rotary shutter disc when in the open condition of the shutter means arranged to be positioned substantially in register with the circumferentially-extending bore of the annular cylinder space to permit passage of the piston through the shutter disc.

The aperture of the shutter may be provided substantially radially in respect of the shutter disc, or indeed may be of a suitable shape to allow for the shape of the piston.

Preferably the axis of rotation of the rotor is non-parallel to the axis of rotation of the shutter disc. Most preferably the axis of rotation of the rotor is substantially orthogonal to the axis of rotation of the shutter disc.

Preferably the piston is so shaped that it will pass through an aperture in the moving shutter means, without balking, as the aperture passes through the annular cylinder space. The piston is preferably shaped so that there is minimal clearance between the piston and the aperture in the shutter means, such that a seal is formed as the piston passes through the aperture. A seal may be provided on a leading or trailing surface or edge of the piston. In the case of a compressor a seal could be provided on a leading surface and in the case of an expander a seal could be provided on a trailing surface.

The rotor body is preferably rotatably supported by the stator rather than relying on co-operation between the pistons and the cylinder walls to relatively position the rotor body and stator. It will be appreciated that a rotary piston and cylinder device is distinct from a conventional reciprocating piston device in which the piston is maintained coaxial with the cylinder by suitable piston rings which give rise to relatively high friction forces.

The rotor may be rotatably supported by suitable bearing means carried by the stator.

Preferably the stator comprises at least one inlet port and at least one outlet port.

Preferably at least one of the ports is substantially adjacent to the shutter means.

Preferably the ratio of the angular velocity of the rotor to the angular velocity of the shutter disc may be 1:1, other ratios may be envisaged The rotor may comprise a (circular) concave surface which defines, in part, with the stator, the cylinder space. The rotor may in some embodiments comprise a central aperture to allow a rotational transmission between the disc and the rotor to extend therethrough.

The shutter disc may be arranged to extend through the cylinder space at one region of the cylinder space.

The device may comprise one or more features described in the description below and/or shown in the drawings.

BRIEF DESCRIPTION OF THE DRAWINGS

Various embodiments of the invention will now be described, by way of example only, with reference to the following drawings in which:

FIG. 11 is a perspective view of a shutter disc arranged with a non-linear close-running region, FIG. 12 is a perspective view of a first piston blade, FIG. 13 is a perspective view of a modified piston blade.

DETAILED DESCRIPTION

Figure 1A:
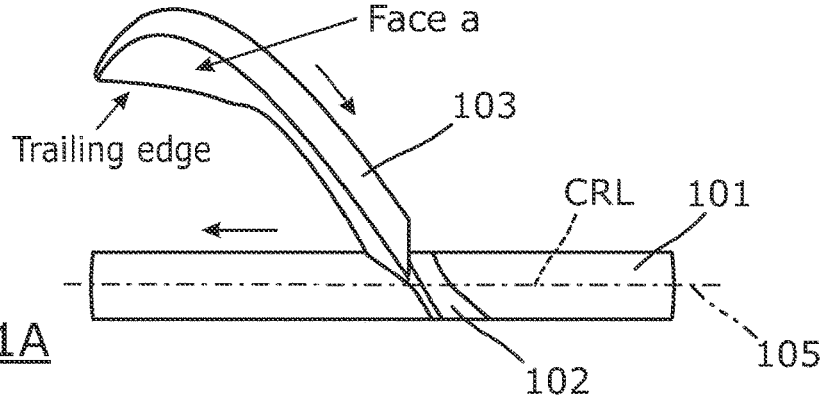
FIG. 1A shows an end on view of a piston blade beginning to enter a slot in a shutter disc, viewed through a wall of the rotor, which is omitted for clarity.
Figure 1B:
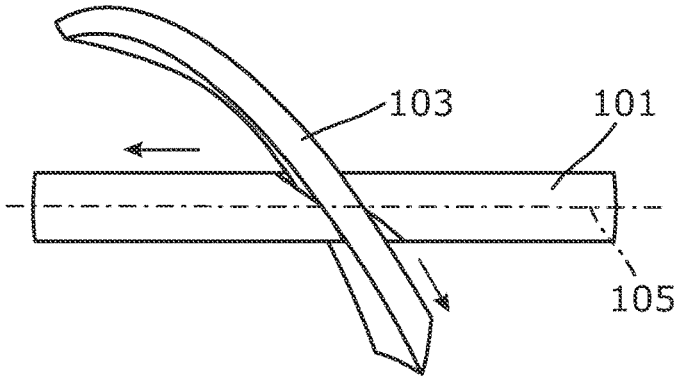
FIG. 1B shows the embodiment of FIG. 1A in which the piston blade is passing through the slot in the shutter disc.
Figure 1C:
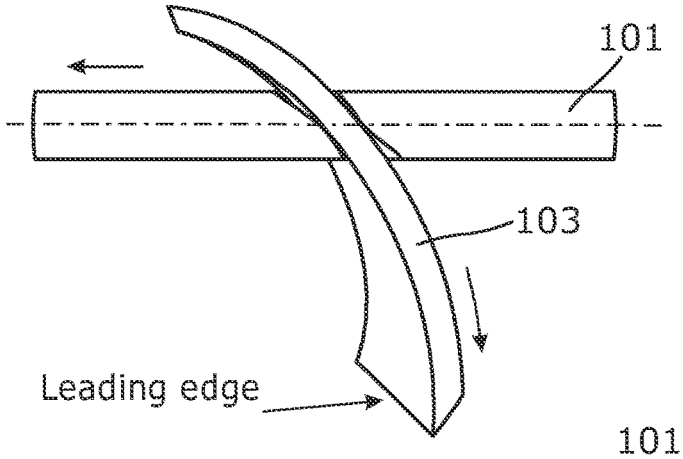
FIG. 1C shows the embodiment of FIGS. 1A and 1B in which the piston blade has passed further through the slot in the shutter disc.
Figure 1D:
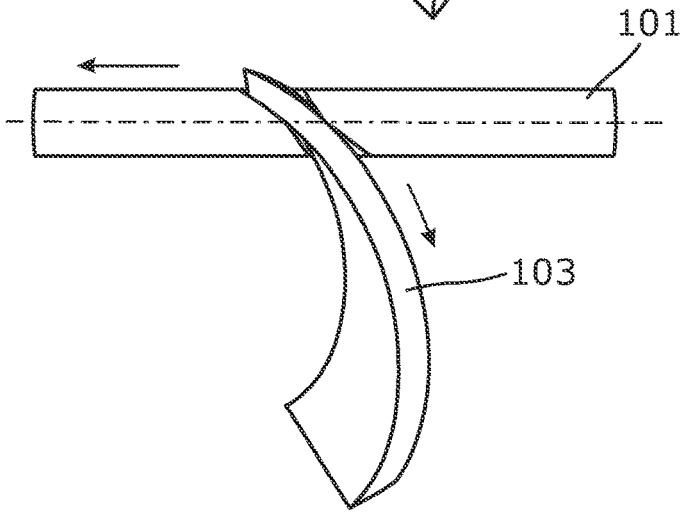
FIG. 1D shows the embodiment of FIGS. 1A, 1B and 1C, in which the piston blade has nearly completed its pass through the slot in the shutter disc.
Figure 2:
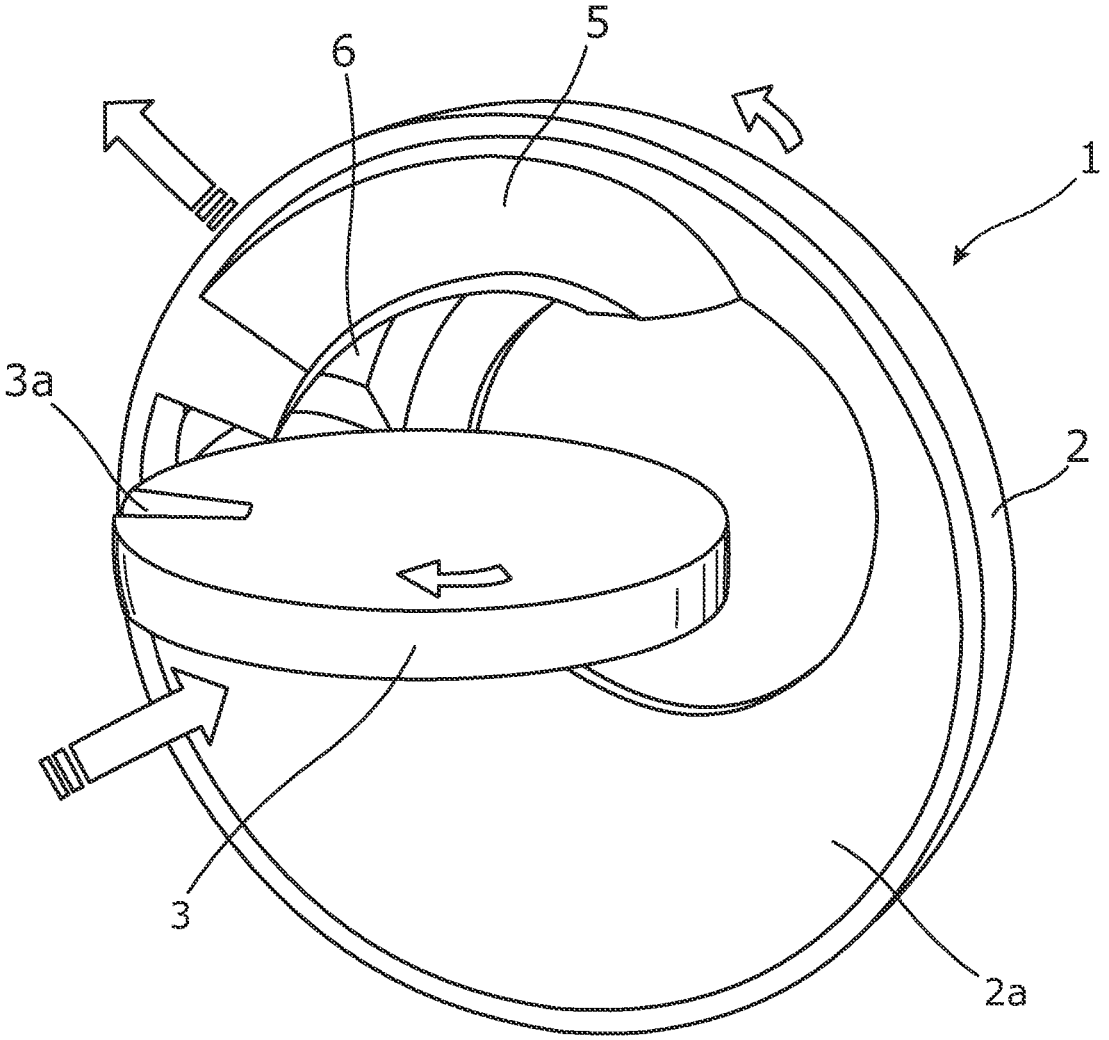
FIG. 2 is a perspective view of a rotary piston and cylinder device.

Reference is made to FIG. 2 which shows a rotary piston and cylinder device 1 which comprises a rotor 2, a stator (not shown), and a shutter disc 3. The stator comprises a formation which is maintained relative to the rotor, and a surface of the stator facing the inner surface 2*a* of the rotor, together define a cylinder space. The stator may also comprise a portion which is located rearwardly, of the rotor, and so the rotor effectively located between the two stator portions. Integral with the rotor and extending from the inner surface there is provided a blade 5. A slot 3*a* provided in the shutter disc 3 is sized and shaped to allow passage of the blade therethrough. Rotation of the shutter disc 3 is geared to the rotor by way of a transmission assembly to ensure that the timing of the rotor remains in synchrony with the shutter disc. The transmission assembly comprises an arrangement of gears. The rotor comprises an outlet port 6.

In use of the device, a circumferential surface 30 of the shutter disc faces the inner surface 2*a* of the rotor so as to provide a seal therebetween, and so enable the shutter disc's functionality to serve as a partition within the cylinder space to be achieved. In the embodiments described below, aspects of the sealing between the shutter disc and the slot of the shutter disc are disclosed.

The geometry of the interior surface 2*a* of the rotor is governed by the curved circumferential surface of the rotating shutter disc. Since the disc (preferably) penetrates only one side of the (annular) cylinder, the axes of the disc and rotor will not generally intersect. Since the disc will also have a thickness, it will be understood that it cannot form a uniform seal along the entirety of its outer face.

Figure 3:
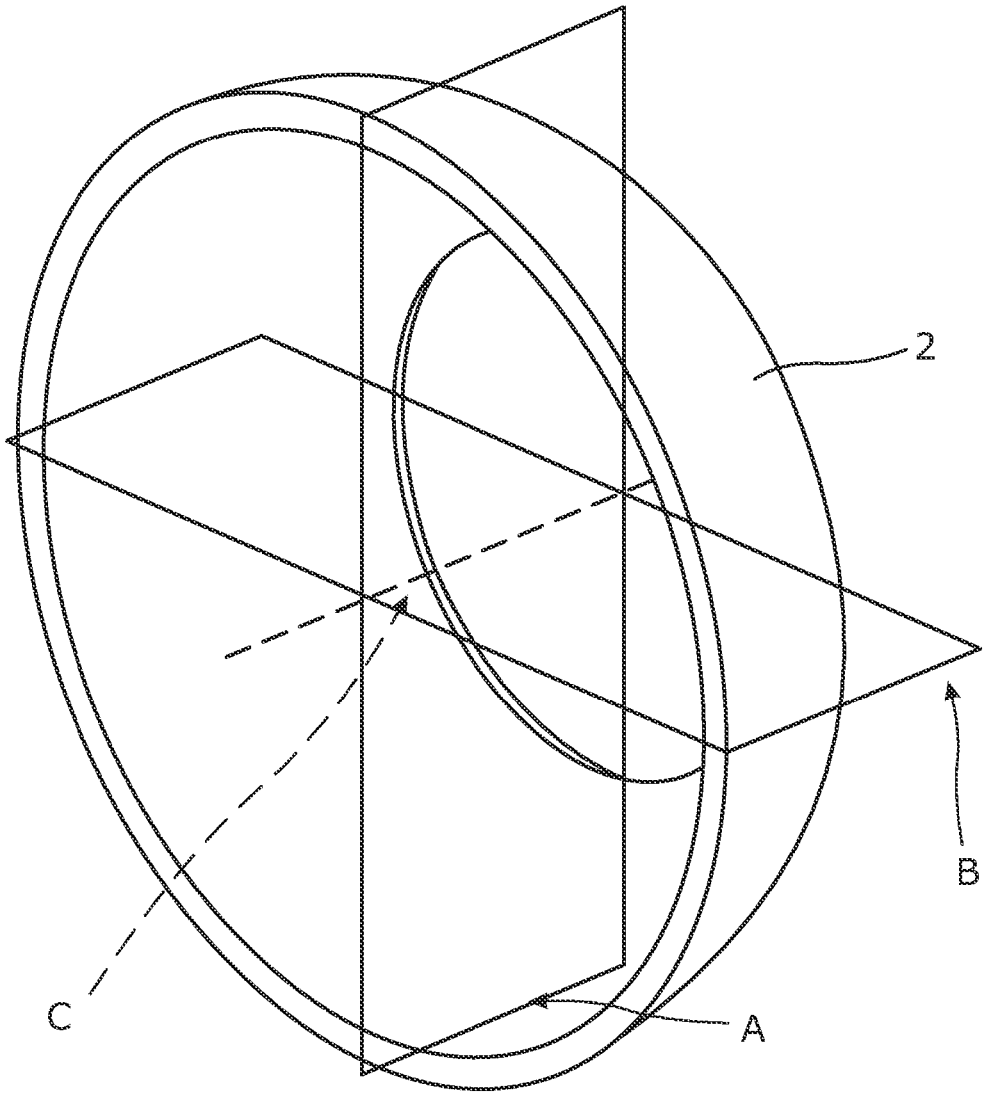
FIG. 3 is a perspective view of a rotor of the device of FIG. 1 showing various planes and an axis of rotation of the rotor.

In some embodiments the centre plane of the rotor 2 can also be considered as a radial plane, which is coincident with the axis of the rotor. Reference is made to FIG. 3 which shows the planes, denoted A and B and the axis of rotation of the rotor, denoted C. The plane B is orthogonal to the plane A.

Figure 4:
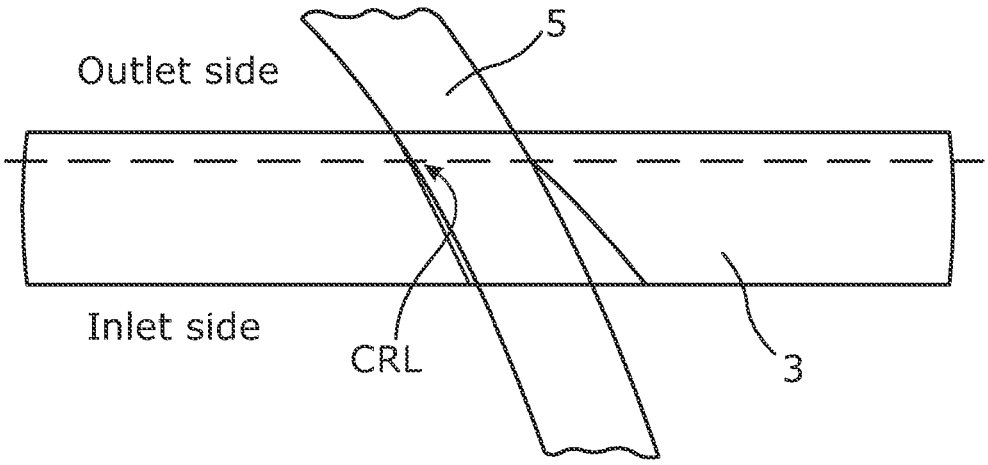
FIG. 4 is an end on view of a piston blade passing through a shutter disc slot.

FIG. 4 shows a side-view of a disc (looking radially towards the centre of the device, in a compressor configuration) where the plane containing the close-running line is offset from the mid-plane of the disc towards the outlet side of the device. With such an arrangement, the lead-in to the close-running line is substantially shorter than the lead-out. This has a number of implications which will vary in relative importance for different configurations of the device, and for each one will dictate whether this direction of sealing perimeter plane offset is more appropriate than the reverse.

A shorter lead-in to the CRL increases the length of the lead-out. In some embodiments this reduces the clearance of the gap formed between the piston and disc before the leading edge of the piston first reaches the CRL. If the embodiment is configured as a compressor with piston-aperture interaction of the type shown in FIGS. 1A to 1D, a smaller gap reduces leakage of pressurised working fluid away from the outlet cylinder, which is a significant contribution to performance of the device. A longer slot lead-out face also improves sealing between the piston and disc earlier during the outlet, when improved sealing is beneficial. The shorter sealing land towards the end of the outlet cycle can increase fluid leakage, reducing pressure spikes within the cylinder.

Figure 5:
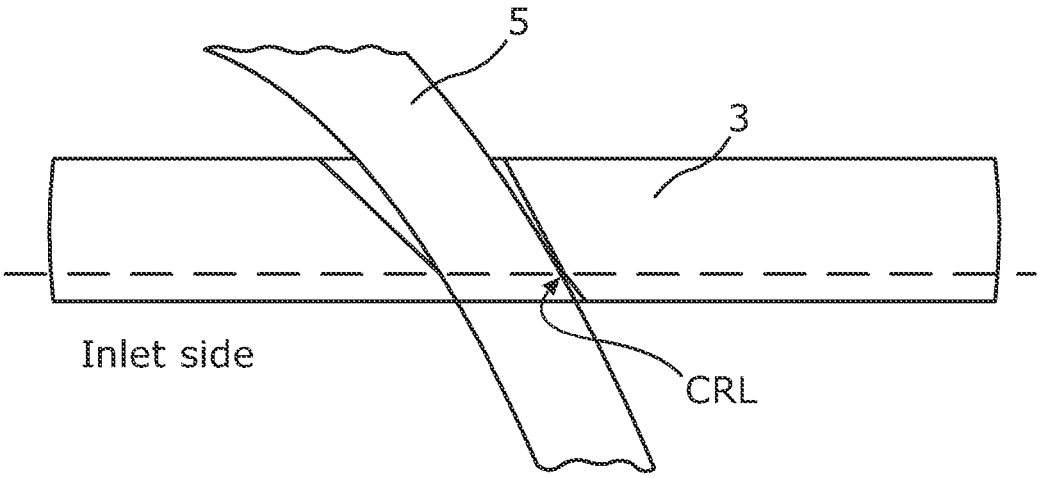
FIG. 5 is an end on view of a piston blade passing through a shutter disc slot.

As shown in FIG. 5, it is also possible to offset the plane of the sealing perimeter towards the inlet side of the disc. While this approach can show the problems cited above, a longer lead-in can allow the working fluid remaining in the cylinder towards the end of the cycle to be more effectively vented through the lead-in volume into one of the outlet apertures, as such a configuration exposes more port area towards the end of a cycle. This is beneficial as it can reduce any pressure spikes at the end of a cycle, and hence the associated temperature and input power increases. If the device is configured as a vacuum pump or expander, the reverse logic applies, and positioning the sealing line towards the inlet side of the disc produces an equivalent scenario.

Figure 6A:
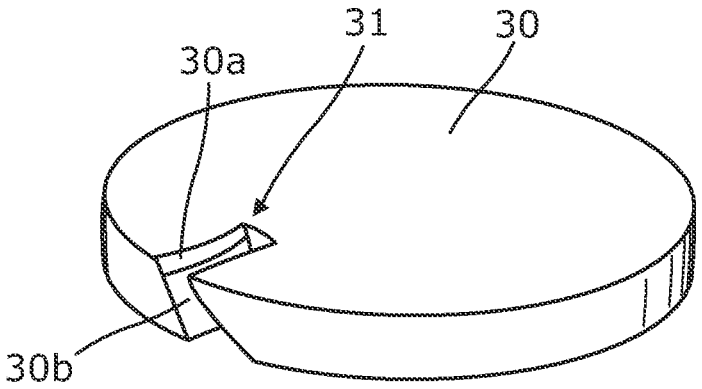
FIG. 6*a* is a perspective view of a shutter disc.
Figure 6B:
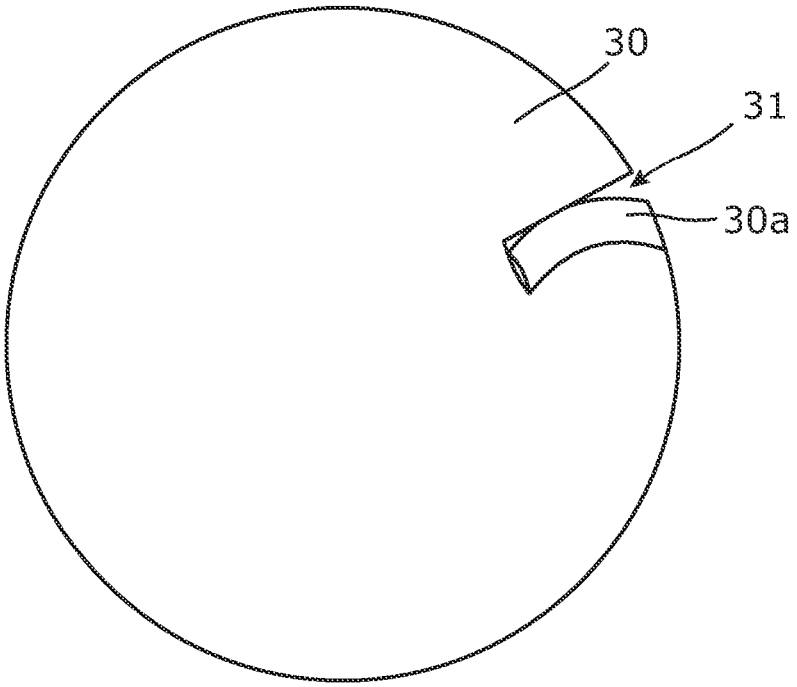
FIG. 6*b* is a plan view of the shutter disc of FIG. 6*a*.

In one embodiment, the sealing region may be substantially non-linear. An embodiment in which the sealing line is curved is shown in FIGS. 6*a* and 6*b* such that it results in a blade which presents a substantially concave face to the working fluid, improving dynamic flow of the fluid towards the outlet port at the end of a cycle. The curvature can be best seen in a plan view of the shutter disc in FIG. 6*b*. The shutter disc comprises a lead-in surface 30*a* and a lead-out surface 30*b*. Depending on the dynamics of the fluid around the piston blade, the shape of the sealing line can be used to improve the inlet flow, the outlet flow, and/or the behaviour of the working fluid during the cycle. The type of curve shown in FIGS. 6*a* and 6*b* also improves the seal between the radially inner (with respect to the rotor) face of the blade and the curved inner stator surface, since for a given swept volume the curved blade will have a wider top face. Similarly, for a given radially inner face width, such a curved working face will result in a larger swept volume.

Figure 7A:
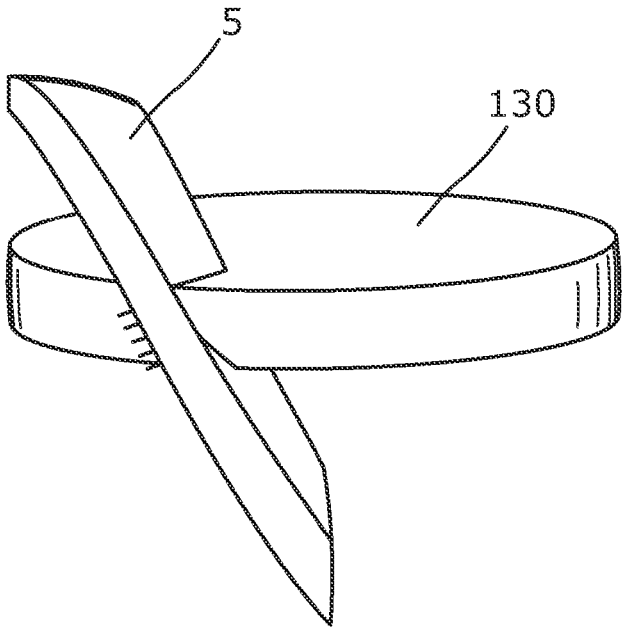
FIG. 7*a* shows a piston passing through the slot of a shutter disc.
Figure 7B:
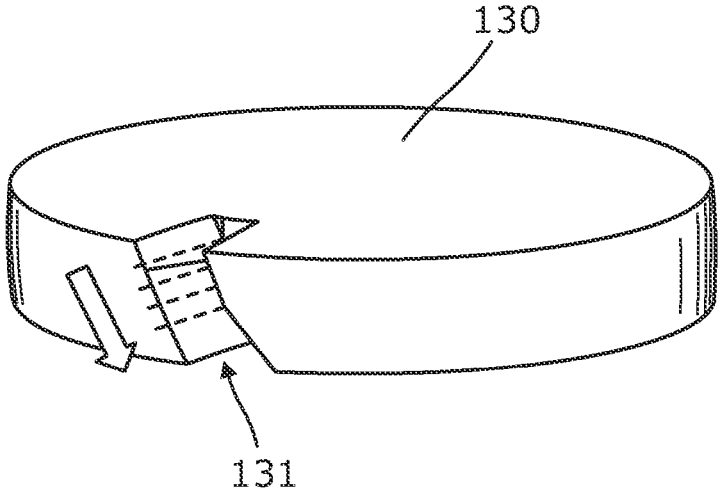
FIG. 7*b* is a perspective view of the shutter disc of FIG. 7*b*.

A further embodiment is shown in FIGS. 7*a* and 7*b*, where the close-running line moves through the thickness of the disc during the time that the blade is passing through the disc. This embodiment can improve sealing by further decreasing the lead-in and lead-out either side of the contact during the blade passage. The close-running line is located close to the outlet side of the disc as the blade approaches, leaving enough lead-in to provide a chamfer to minimise damage to the blade. During the passage of the blade through the disc 130, the close-running line moves closer to the inlet side of the disc, with the aim of being closer to the face of the blade at any given time during the passage to more closely resemble the shape of the aperture around it. Examples of different close running line positions are shown in broken lines, which translate down the working surface of the disc slot 131, as shown pictorially by the solid arrow.

In one embodiment, the close-running line after progressing away from the lead-in, will then move back towards the outlet side of the disc after a certain point in the blade passage, and become largely coincident with the initial close-running line. This enables the shape of the aperture to be maintained without it being influenced by the lead-in that would otherwise be required at the same location. Instead, the lead-in is entirely contained within the region between the position of the initial (and hence final) close-running line and the outlet-facing face of the disc, where it provides a chamfer for the blade at the beginning of the passage.

Figure 8A:
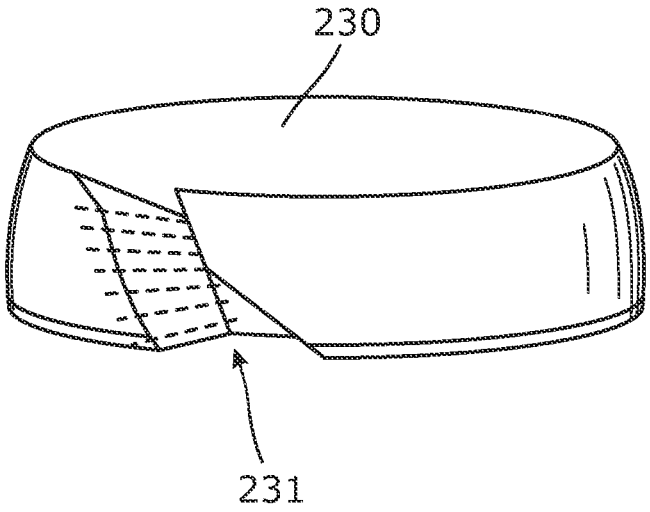
FIG. 8*a* is a perspective view of a shutter disc with an inverted conical side.
Figure 8B:
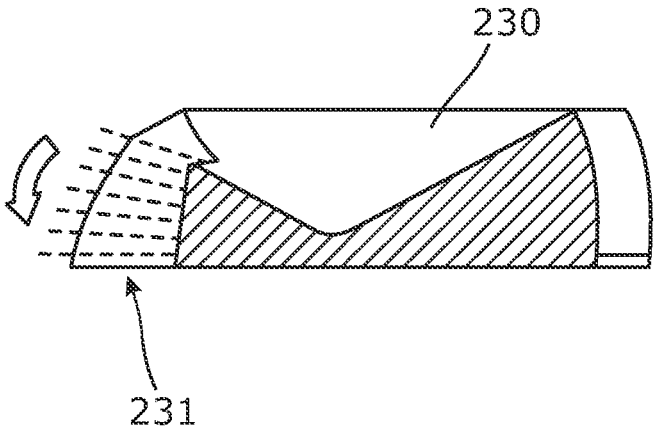
FIG. 8*b* is a sectional view of the shutter disc of FIG. 8*a*.

A further embodiment is shown in FIGS. 8*a* and 8*b*. The close-running line is arranged to rotate with respect to the disc's normal plane during the passage of the blade through the disc 230. Broadly, this is applicable to scenarios where the disc is substantially not planar, being for example conical or inversely conical, as shown in the Figures. This serves the same function as described above: to minimise leakage and minimise blade damage at the start of the passage of the blade, and to improve sealing of the piston passage through the disc during the blade passage by reducing the distance between the facing surfaces each side of the close-running line. As shown in broken line the close-running line is substantially parallel to the conical disc surface at the outlet side of the disc at the start of the blade passage. The close-running line then rotates during the blade passage, such that it moves towards the inlet side of the disc. The close-running line would then move back towards its initial orientation to provide the clearance required for the trailing edge of the blade.

Figure 9:
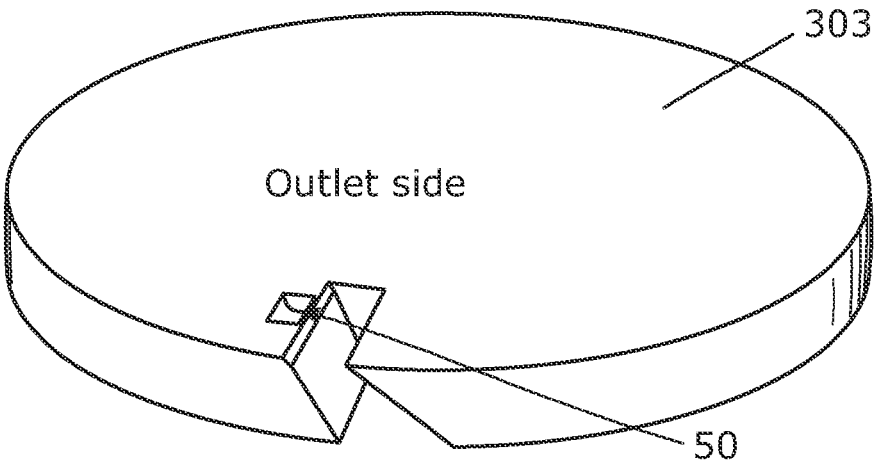
FIG. 9 is a perspective view of a shutter disc with a flow-altering indentation on a side face thereof.

FIG. 9 shows a further embodiment of the present invention, that also provides pressure relief at the end of the stroke. Here the outlet face of the shutter disc 303 has a recess 50 that allows air at the end of a stroke to be vented out past the radially inner wall of the cylinder. It is important to note that for such a feature to be viable, one of the radially outer wall of the rotor and the radially inner wall of the cylinder can be different geometries/thicknesses, as otherwise the pressure relief feature would provide a leak path as it first enters the cylinder just before the start of the blade passage through the disc. The pocket may communicate with an interior space of the disc if the disc is hollow.

Figure 10:
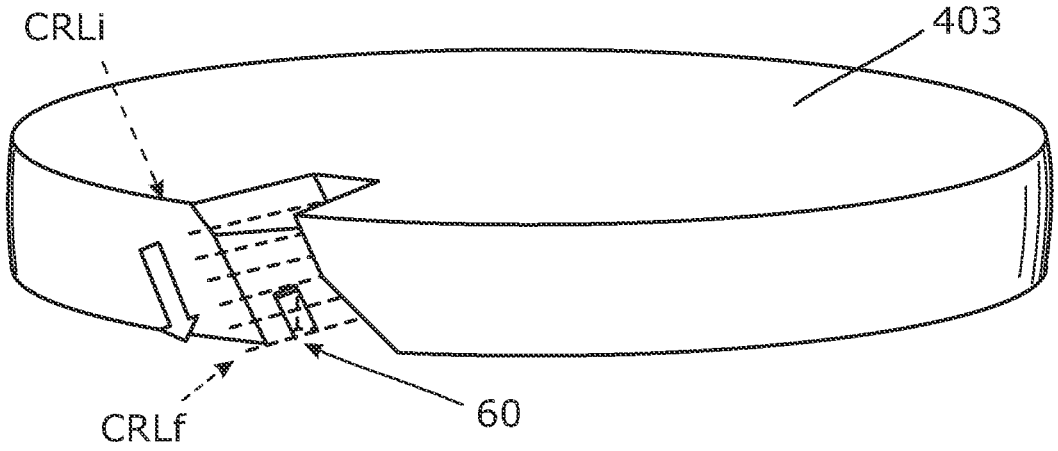
FIG. 10 is a perspective of a shutter disc with a flow altering indentation located within the slot of the disc.

A further shutter disc variant of the embodiment shown in FIG. 10 in which an indentation in a shutter disc 403 is provided on the sealing interface, such that it forms a discontinuity on the close running line, to increase leakage of working fluid. This may be realised with a fixed close-running line, but is preferably implemented with a moving and/or rotating close-running line, that only intersects the indentation towards the end of a cycle. An initial close-running line is referenced as CRLi and a final close-running line is referenced as CRLf.

A further embodiment of the invention is shown in FIG. 11 where the close-running line CRL of a shutter disc 503 is curved (and in more than one dimension) such that it cannot substantially be contained on a single plane. Such an embodiment can allow wear on an abradable coating (if used) to be more tightly controlled by prescribing an angle between the close-running line at any point on the disc, and the relative surface velocity of the blade. The optimum conditions would vary for each configuration of the device, and specifically depend on the characteristics of the abradable coating used. Due to the extra options available, it is also possible to use such a scenario to more effectively control gas dynamics within the cylinder, beyond the less complex solutions described above.

Figure 14:
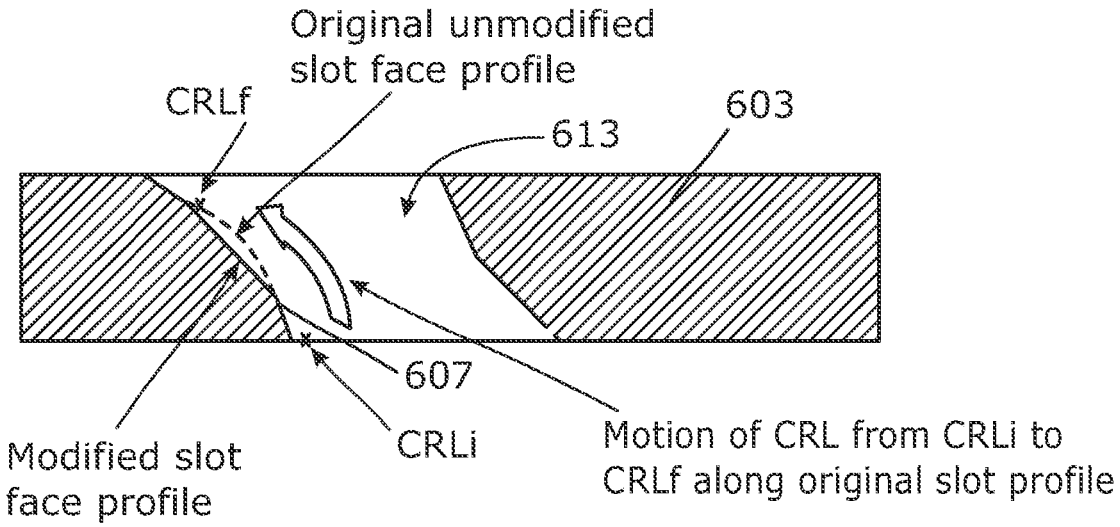
FIG. 14 is a cross-sectional view parallel to a tangent of the disc through the slot.

In a variant of the embodiment, the width of the sealing gap along the close-running line increases towards the end of the passage of the blade through the disc, such that extra leakage of working fluid is permitted through the sealing gap into the inlet cylinder. This could serve to reduce any potential pressure spikes at the end of a cycle in a compressor embodiment. Such a feature could be implemented either as an offset of the close-running line in the aperture (in case a moving close-running line is used, or as a partially offset face of the blade, or a combination of both). Reference is made to FIGS. 12 and 13 which show the mathematically ideal blade geometry 115*a*, and a blade in which a trailing section 115*b* of the blade has material removed, respectively. The offset surface 115*b* of increases the sealing gap at the end of the blade's passage through the shutter disc slot. Reference is also made to FIG. 14 which shows how suitable geometry of the surface 607 of the shutter disc 603 has been modified such that the close-running lines CRL are modified towards the end of the passage of the blade through the slot such that the seal gap is increased at those points. This slot modification increases fluid leakage towards the end of piston passage through the slot.

Figure 15:
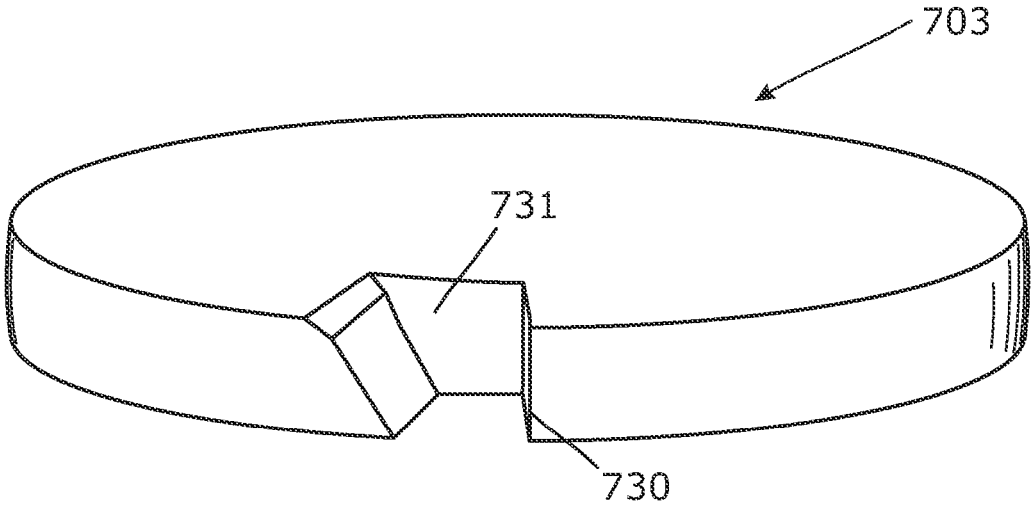
FIG. 15 is a perspective view of a shutter disc in which the face which does not interact with the working face of the piston to generate the close-running line is configured for ease of manufacture.

FIG. 15 shows a variant embodiment of a shutter disc 703, in which a surface 730 (which does not interact with a working surface of the piston) of the slot 731 is formed as a square-cut, for ease of manufacture.

Figure 16:
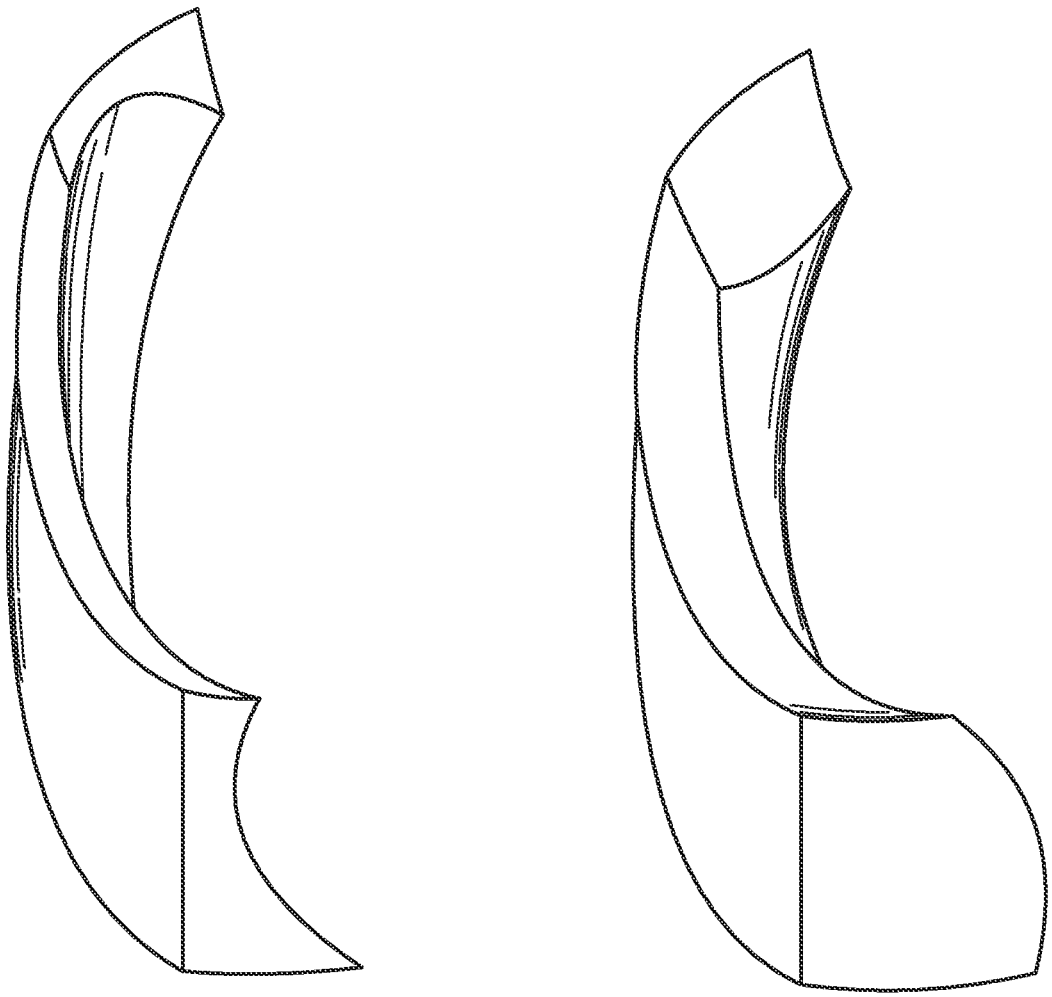
FIG. 16 shows perspective views of two possible piston shapes.

Although the above embodiments are generated by first creating a slot profile, and then generating a suitable piston shape to pass therethrough (and form the required CRL), alternatively it is possible to start with a desired piston shape, and create a slot to accommodate it. Two such possible piston shapes are shown in FIG. 16. These provide the same effect, in terms of close-running line, as starting with a desired slot profile.

In the above described embodiments, the close running region or line is arranged to be offset from the central plane of the shutter disc, during at least part of the passage of the blade through the aperture slot. Advantageously, by doing so offers various ways in which to better effect the seal between the blade and the working surface of the slot of the shutter disc, and in relation to different scenarios for different applications and to achieve various desired results, some of which are outlined above.

Figure 17:
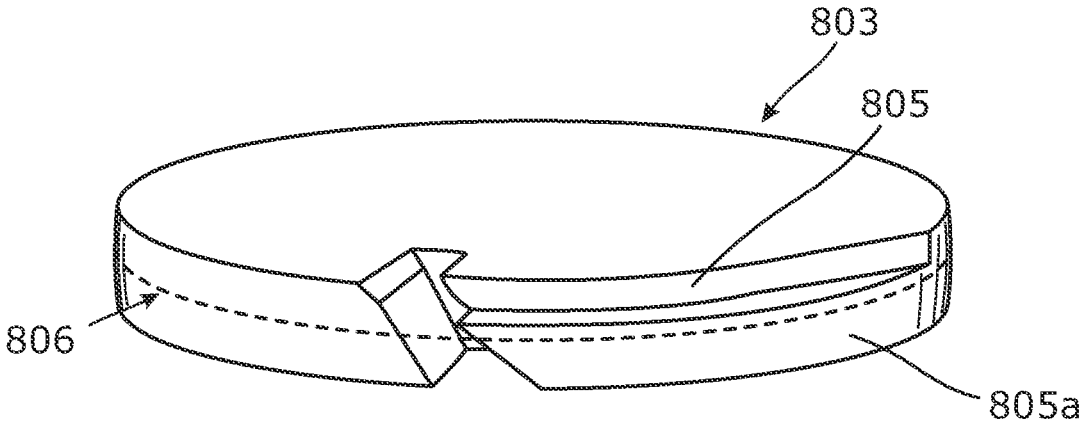
FIG. 17 shows a perspective view of a variant shutter disc.
Figure 18:
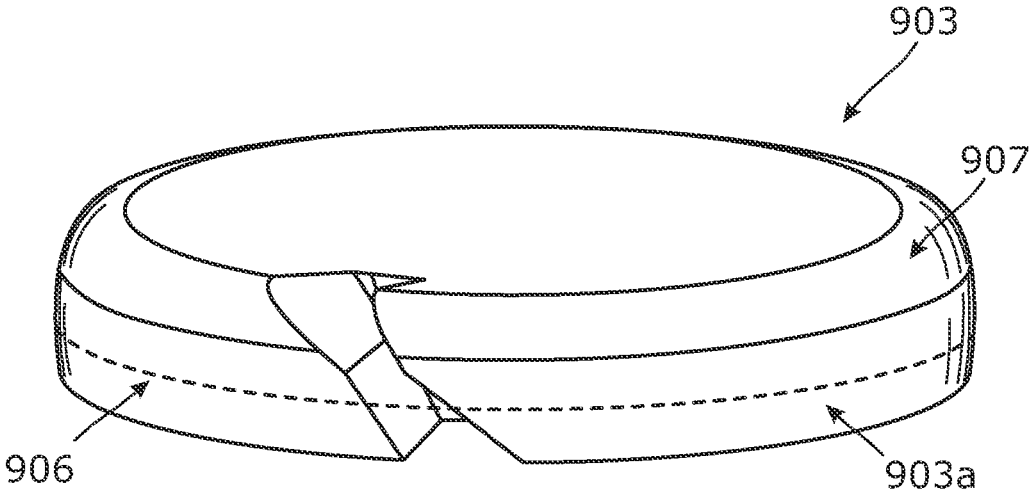
FIG. 18 shows a perspective view of a further variant shutter disc.

FIGS. 17 and 18 show variant embodiments of shutter discs with 'irregular' circumferential disc surfaces. In FIG. 17 a shutter disc 803 includes a cut-out portion 805. For the major part of the extent of the circumferential surface 805*a* the mid-plane 806 of the disc lies at halfway of the height of the circumferential surface. However, in the region adjacent to the cut-out portion 805, the mid-plane, in the vicinity of that portion of the circumferential surface is offset relative to the height of the portion. In FIG. 18, shutter disc 903 is shown in which a curved extension portion 907 is provided which increases the overall thickness of the disc. The curved extension is located beyond the circumferential surface 903*a* which acts in close co-operation with the rotor. The mid-plane is the disc lies halfway of the circumferential surface 903*a*. In this embodiment, the mid-plane 906 is not central of all of the disc (thickness).

The invention claimed is:

1. A rotary piston and cylinder device comprising a rotor, a stator and a shutter disc, the rotor comprising a piston which extends from the rotor into the cylinder space, the rotor and the stator together defining the cylinder space, the shutter disc passing through the cylinder space and forming a partition therein, and the shutter disc comprising a slot which allows passage of the piston therethrough, the slot provided between two surface portions which receive the piston therethrough, at least one of the surfaces defines a close-running region with the piston to provide a fluid seal, and for at least part of the period during which the piston passes through the slot, the close-running region is offset from a mid-plane which extends through the shutter disc and is co-planar with the shutter disc, wherein the close-running region comprises a sealing gap between the piston and the shutter disc.

2. The rotary piston and cylinder device as claimed in claim 1 in which the close-running region translates relative to the thickness of the shutter disc during progression of the piston through the slot.

3. The rotary piston and cylinder device as claimed in claim 1 where the close-running region is spaced by a distance of 0-20% of the shutter disc thickness from one of the opposing sides of the shutter disc for at least part of the piston's progression through the slot.

4. The rotary piston and cylinder device as claimed in claim 1 in which the close-running region is non-parallel to the mid-plane of the shutter disc.

5. The rotary piston and cylinder device as claimed in claim 1 in which an orientation and/or shape of the close-running region varies during passage of the piston through the shutter disc slot.

6. The rotary piston and cylinder device as claimed in claim 1 in which the close-running region is linear.

7. The rotary piston and cylinder device as claimed in claim 1 in which the close-running region is non-linear.

8. The piston and cylinder device as claimed in claim 1 which comprises a leakage clearance between the shutter disc and the at least one surface of the slot to allow at least part of the fluid to be discharged.

9. The rotary piston and cylinder device as claimed in claim 1 which is arranged to vary a rate of working fluid leakage during an operational cycle of the device.

10. The rotary piston and cylinder device as claimed in claim 9 which is arranged to vary working fluid leakage during the passage of the piston through the shutter disc.

11. The rotary piston and cylinder device as claimed in claim 9 which comprises an indentation or recess in at least one of the shutter disc and the piston, and is located at sealing interface.

12. The rotary piston and cylinder device as claimed in claim 11 in which the indentation or recess is arranged so as to influence the close-running region during the passage of the piston through the slot.

13. The rotary piston and cylinder device as claimed in claim 11 in which the indentation or recess crosses the close-running region during passage of the piston through the slot.

14. The rotary piston and cylinder device as claimed in claim 13 wherein the sealing gap arranged to increase or decrease during at least part of the piston's passage through the slot.

15. The rotary piston and cylinder device as claimed in claim 11 in which the indentation or recess communicates with a volume within the shutter disc.

16. The rotary piston and cylinder device as claimed in claim 11, wherein the shutter disc is at least in part hollow.

17. The rotary piston and cylinder device as claimed in claim 9 which comprises an indentation on a side of the shutter disc.

18. The rotary piston and cylinder device as claimed in claim 1 in which the sealing gap at sealing interface along the close-running region arranged to vary during the passage of the piston through the shutter disc.

19. The rotary piston and cylinder device as claimed in claim 1 in which the mid-plane is the mid-plane of the shutter disc such that is passes through a centre of the height of a circumferential surface of the shutter disc for at least part of, and preferably a major angular extent of, said circumferential surface.

20. The rotary piston and cylinder device as claimed in claim 1 in which the two surfaces between which the slot is defined are opposing surfaces.

* * * * *